US005979960A

United States Patent [19]

Osmar

[11] Patent Number: 5,979,960

[45] Date of Patent: Nov. 9, 1999

[54] TISSUE GRASPER

[76] Inventor: Per E. Osmar, P.O. Box 38, Clam Gulch, Ak. 99568

[21] Appl. No.: 09/211,278

[22] Filed: Dec. 14, 1998

[51] Int. Cl.[6] ..... B25B 9/02

[52] U.S. Cl. ..... 294/99.2; 294/61

[58] Field of Search ..... 294/3, 8.5, 11, 294/16, 33, 61, 99.2, 902; 221/36, 40, 210, 213; 271/18.3; D7/683–686; D28/55

[56] References Cited

U.S. PATENT DOCUMENTS

| | | | |
|---|---|---|---|
| D. 49,863 | 11/1916 | Seaman | D7/686 |
| 1,250,500 | 12/1917 | Pipp | 294/99.2 |
| 2,768,856 | 10/1956 | Wright | 294/99.2 |
| 2,777,724 | 1/1957 | Carter | 294/61 |
| 2,839,325 | 6/1958 | Jeanfavre | 294/99.2 |
| 3,012,692 | 12/1961 | Petersen . | |
| 3,155,273 | 11/1964 | Cote . | |
| 3,248,006 | 4/1966 | Lowery et al. | 221/210 |
| 4,200,200 | 4/1980 | Hein, III et al. . | |
| 4,623,074 | 11/1986 | Dearwester . | |
| 4,905,870 | 3/1990 | Mamolou | 294/99.2 |
| 4,944,405 | 7/1990 | Buford et al. . | |
| 4,997,224 | 3/1991 | Pierce | 294/33 |
| 5,044,058 | 9/1991 | Voss | 294/99.2 |
| 5,540,354 | 7/1996 | Annand . | |

FOREIGN PATENT DOCUMENTS

| | | | |
|---|---|---|---|
| 266868 | 5/1950 | Switzerland | 294/99.2 |

*Primary Examiner*—Dean J. Kramer
*Attorney, Agent, or Firm*—Christensen O'Conner Johnson & Kindness PLLC

[57] ABSTRACT

Corresponding ends of long, narrow legs are joined together for resilient spring like movement toward and away from each other. The swinging ends of the legs have inward extending flanges with flat bottom portions and teeth projecting downward beyond the botttoms. The legs can be inserted into a tissue box and pressed gently against the top tissue of the box, whereupon the legs are brought together so that the flanges and their teeth pinch or grasp the top tissue of a stack, for withdrawing the top tissue when the legs are removed from the box.

1 Claim, 2 Drawing Sheets

TISSUE GRASPER

FIELD OF THE INVENTION

The present invention relates to a specialized instrument for grasping a single tissue from the top of a boxed stack of tissues.

BACKGROUND OF THE INVENTION

U.S. Pat. No. 3,155,273, issued May 31, 1963, to R. A. Cote, and U.S. Pat. No. 4,200,200, issued Apr. 29, 1980, to Carl C. Hein, III, and Joseph J. Spitz, disclose cartons for stacks of interfolded tissues. In each instance, the top of the carton has an opening for access to the interior, but the opening is closed by a film having a longitudinal slit. The slit forms a "valve" having abutting or nearly abutting, somewhat flexible lips. A single tissue projecting through the lips may be pulled for removal from the box. Ideally, the next lower tissue is drawn through the valve and retained in a position partially projected from the box. However, in this type of construction, the next lower tissue is not always reliably drawn through the valve or held projecting from it. In that case, the user must insert his or her fingers downward through the valve for access to the next tissue. This procedure is inconvenient, particularly for those with limited dexterity or painful ailments of the fingers or their joints.

Patents on containers seeking to address this problem include the following: U.S. Pat. No. 3,012,692, issued Dec. 12, 1961, to B. B. Petersen; U.S. Pat. No. 4,623,074, issued Nov. 18, 1986, to Donald D. Dearwester; U.S. Pat. No. 4,944,405, issued Jul. 31, 1990, to John C. Buford and Leslie H. Porter; and U.S. Pat. No. 5,540,354, issued Jul. 30, 1996, to Charles A. Annand. In each instance, a container is provided with a side opening for access to stacked tissues. Nevertheless, the valved box having only a top opening continues to be a commonly used container, with the problem noted above.

SUMMARY OF THE INVENTION

The present invention provides a special instrument for removing tissues from a stack, particularly tissues that are interfolded and contained in a box having a valved top opening. In a preferred embodiment, the instrument includes two long, narrow and thin legs disposed parallel or nearly parallel to each other. Corresponding ends of the legs are connected for resilient, spring-like movement toward and away from each other. In a preferred embodiment, the legs are joined by an integral return bent section. At the opposite ends of the legs, each leg has a flange extending inward toward the other leg. Preferably the flanges extend perpendicular to the length of the associated legs, with flat bottoms over the major portion of their extent. The flanges can be formed integrally with the legs. The inner end portions of the flanges can be notched, forming two sharp teeth at the inner edges. Preferably the teeth project below the otherwise planar bottom surfaces of the flanges. In use, the legs of the instrument can be inserted downward through the valved opening of a container having a stack of interfolded tissues. The flanged ends of the tongs are pressed gently against the top tissue, and the planar undersides of the flanges engage flush against the top tissue. The short teeth dig a predetermined distance into the top sheet such that, when the legs are brought together, the top sheet is grasped and can be removed by withdrawing the instrument from the box.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENT

Figure 1:
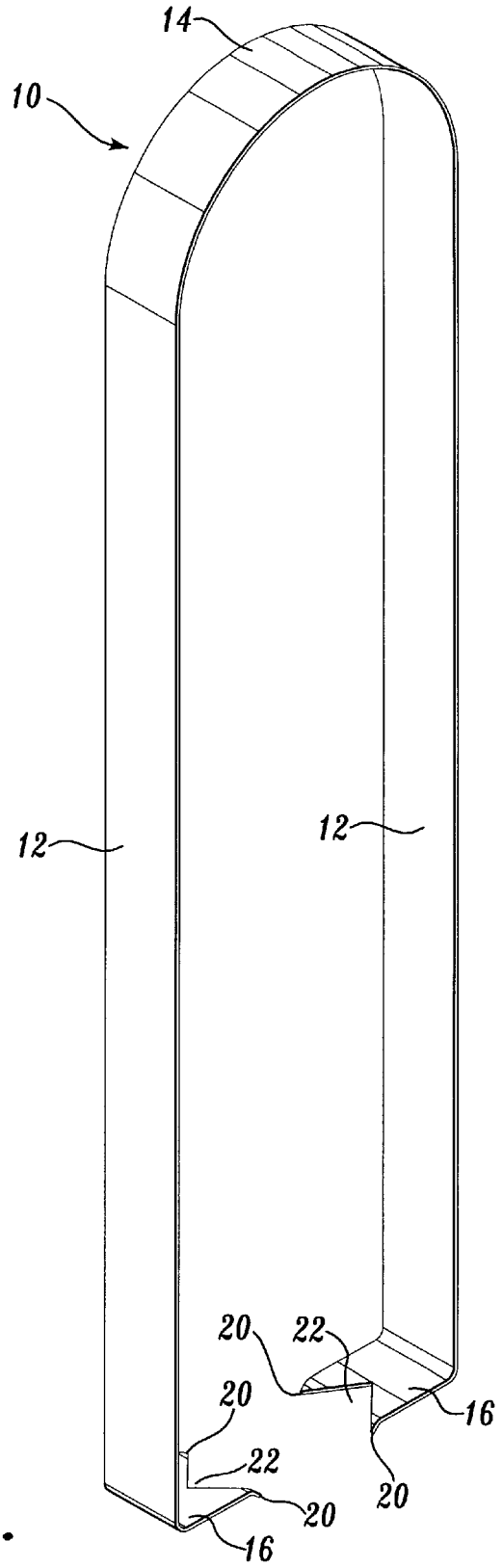
FIG. 1 is a somewhat diagrammatic top perspective of a tissue grasper in accordance with the present invention.

With reference to FIG. 1, a tissue grasper 10 in accordance with the present invention has two long and straight legs 12, much longer than they are wide and much wider than they are thick. Corresponding ends of the legs, the top ends as viewed in FIG. 1, are joined together for resilient movement toward and away from each other. In the illustrated embodiment, the legs 12 are formed integrally with a return bent top portion 14 joining the upper ends of the legs. Section 14 is of the same width and thickness as the leg sections 12. Section 14 allows resilient movement of the legs 12 toward and away from each other, with FIG. 1 illustrating the rest position in which the legs are parallel.

The other ends of the legs, the bottom ends as viewed in FIG. 1, have inward-extending flanges 16, such that each flange extends toward the other with an open space 18 between them in the rest position. In the illustrated embodiment, the entire instrument is formed of a single strip of substantially rigid but somewhat resilient metal or plastic, and the flanges 16 extend essentially perpendicularly inward from the legs 12. The bottom surfaces of flanges 16 are substantially planar, except for short teeth 20 at the inner edges that extend downward below the plane of the otherwise flat bottoms of the flanges. Such bottoms are co-planar. Two such teeth can be formed on each flange by means of a V notch 22.

The tissue grasper 10 can be formed of steel or an injection-moldable plastic. In a preferred embodiment, each leg 12 is about 8½ inches long, and the legs are spaced apart about 2 inches in the rest position. The width of each leg is about ½ inch, and the thickness of each leg is about 0.050 inch. The return bent portion 14 is a semi-circular arc. Each flange extends inward approximately one-half inch from its leg 12, and the teeth 20 are sharply pointed and extend downward below the plane of the bottom surface of each flange by no more than about 1/16 inch.

Figure 2:
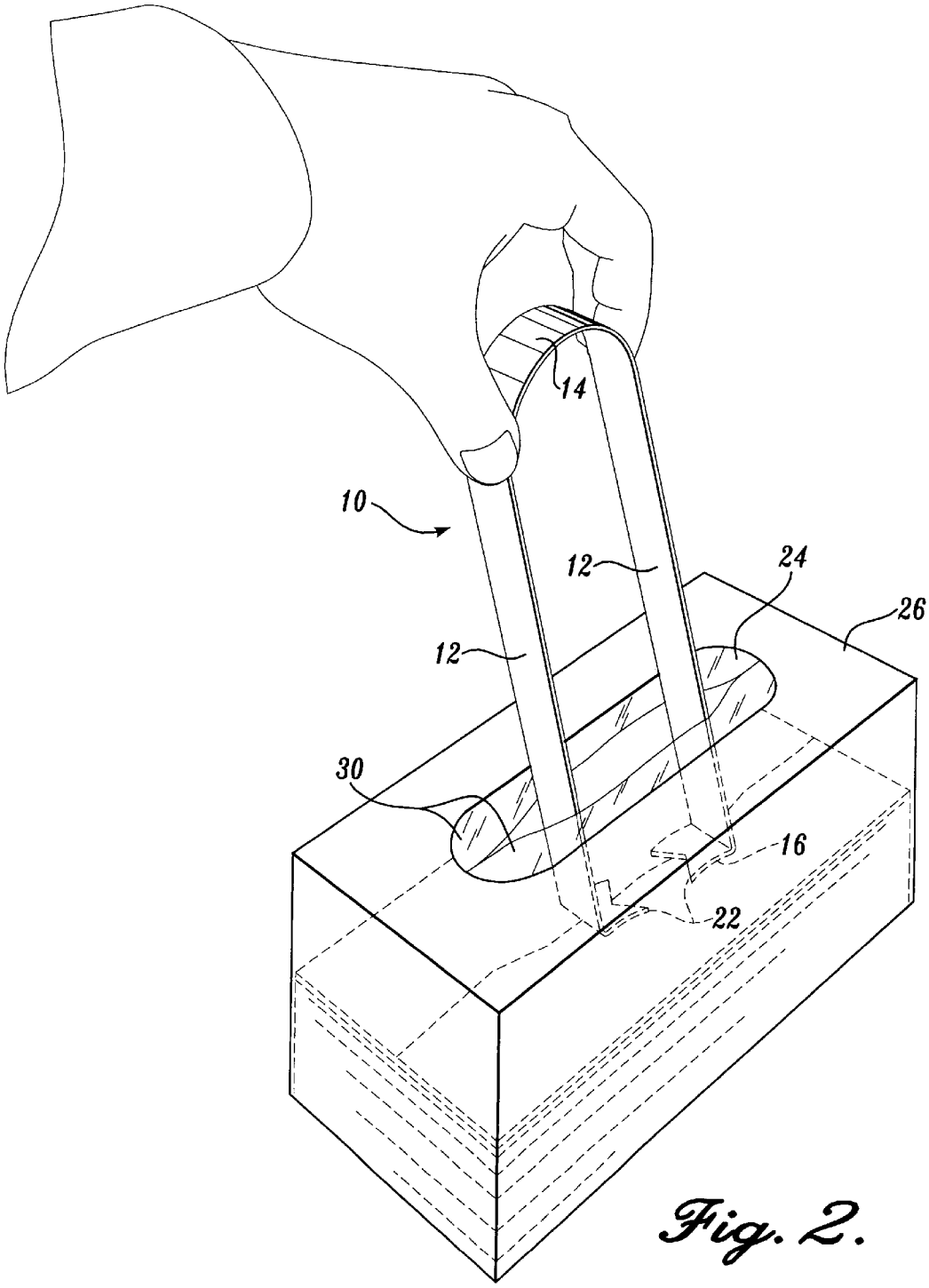
FIG. 2 is a somewhat diagrammatic top perspective of the tissue grasper of FIG. 1 in use for removing a tissue from a box.

With reference to FIG. 2, in use the tissue grasper 10 can be held between the thumb and forefinger toward the upper ends of the legs 12. The bottom ends of the legs 12 are inserted downward through the opening 24 of a box 26 containing a stack of interfolded tissue sheets. Such opening can have the usual film sections 30 to form a valve. Preferably, the legs 12 are maintained substantially perpendicular to the top tissue, such that the flat bottoms of the flanges 16 rest flush against the top sheet. The teeth 22 will dig slightly into the top sheet, such that when the legs are brought together by squeezing at the upper end portion of the grasper, the top sheet, but not a lower sheet, is pinched or grasped sufficiently that it will be withdrawn from the box when the tissue grasper is removed. This avoids the necessity for the user to insert his or her fingers downward through the valved opening of the box.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. A tool for grasping the top tissue of a stack of tissues, said tool comprising two elongated legs each much longer than it is wide and much wider than it is thick, each of the legs having a first end and a second end opposite the first end, the two legs being offset from each other and having their first ends joined together by an integral return bent joining section to permit resilient movement of the second ends of the legs toward and away from each other, the legs being parallel in a rest position from which they can be pressed together for moving the second ends toward each other for grasping a tissue, a pair of coplanar flanges extending inward from the second ends, respectively, each of the flanges having a flat bottom portion for being pressed against the top surface of the top tissue of a stack, the flanges including inner edge portions having V-notches forming sharpened tips at outer sides of the flanges, each flange having at least one tooth extending a short distance downwardly beyond the flat bottom portion at the sharpened tips, the legs, flanges, sharpened tips and teeth being constructed, proportioned and arranged relatively such that the flanges can be pressed against the top tissue of a stack of tissues and brought together by manipulation of the legs to grasp a single tissue at the top of the stack without substantial penetration of the teeth into the next lower tissue of the stack, the legs, return bent joining section, and flanges being integral, having the same width and thickness.

* * * * *